US005501885A

United States Patent [19]

Yeh

[11] Patent Number: 5,501,885

[45] Date of Patent: Mar. 26, 1996

[54] FOLDABLE DECORATION

[76] Inventor: Elane Yeh, P.O. Box 82-144, Taipei, Taiwan

[21] Appl. No.: 342,170

[22] Filed: Nov. 18, 1994

[51] Int. Cl.[6] ..... B44C 3/06

[52] U.S. Cl. ..... 428/9; 428/12; 428/16

[58] Field of Search ..... 428/7, 12, 9, 16

[56] References Cited

U.S. PATENT DOCUMENTS 4,027,057 5/1977 Grumbeck ..... 428/12 X 4,564,538 1/1986 Scholtz ..... 428/12

4,858,669 8/1989 Vinson ..... 428/12 X

*Primary Examiner*—Henry F. Epstein

*Attorney, Agent, or Firm*—Alfred Lei

[57] ABSTRACT

A foldable decoration includes a decorative body, a plurality of sector members having a first side, a straight side and an arc between the first and second sides, each of the sector members being formed with a radial slot and a hole at both ends of the arc, the sector members being assembled so that the first side of one of the sector members is laid upon on the second side of an adjacent one of the sector members and pivotatally connected thereto, and a pin extending through the radial slot of the sector members.

1 Claim, 6 Drawing Sheets

FOLDABLE DECORATION

BACKGROUND OF THE INVENTION

It has been found that the conventional foldable decoration is too monotonous thereby making it dull in a short time. Hence, many attempts have been made to develop foldable decorations with more fun. However, they are too complicated in structure and expensive in cost hence making it difficult to promote.

Therefore, it is an object of the present invention to provide a foldable decoration which can obviate and mitigate the above-mentioned drawbacks.

SUMMARY OF THE INVENTION

This invention relates to a foldable decoration.

It is the primary object of the present invention to provide a foldable decoration which can be folded to change the shape thereby providing much fun in playing.

It is another object of the present invention to provide a foldable decoration which is possessed of a lot of modifications.

It is still another object of the present invention to provide a foldable decoration which is simple in construction.

It is still another object of the present invention to provide a foldable decoration which is low in cost.

It is a further object of the present invention to provide a foldable decoration which is easy to assemble.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 2:
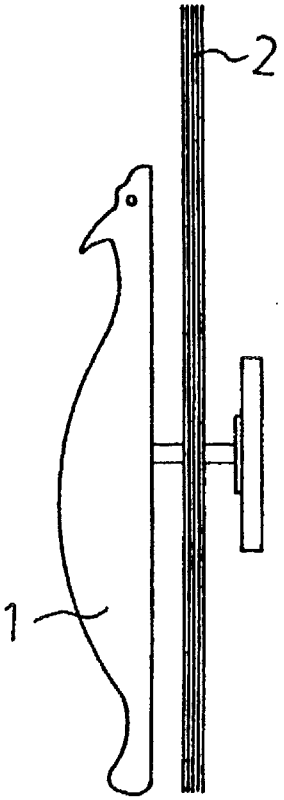
FIG. 2 is a side view of the present invention.
Figure 1:
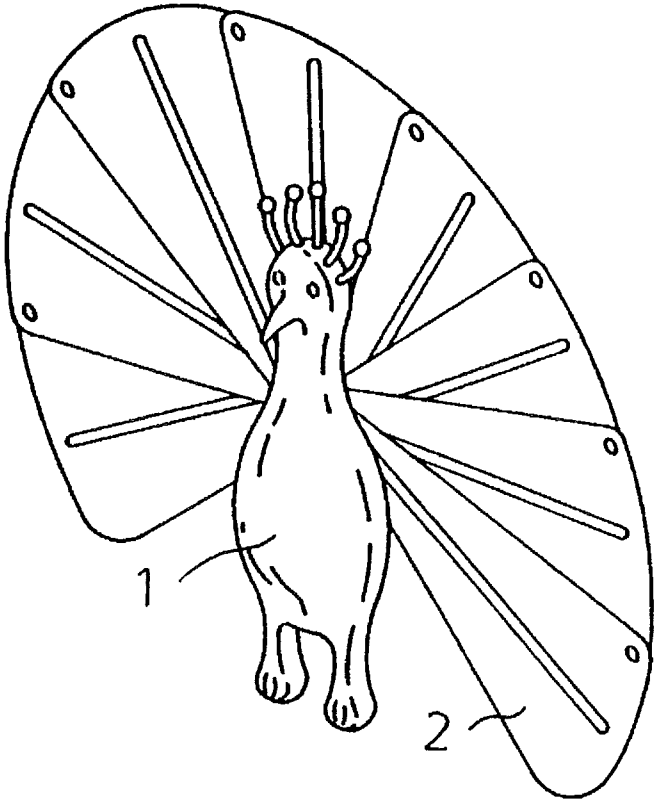
FIG. 1 is a perspective view of the present invention.
Figure 3:
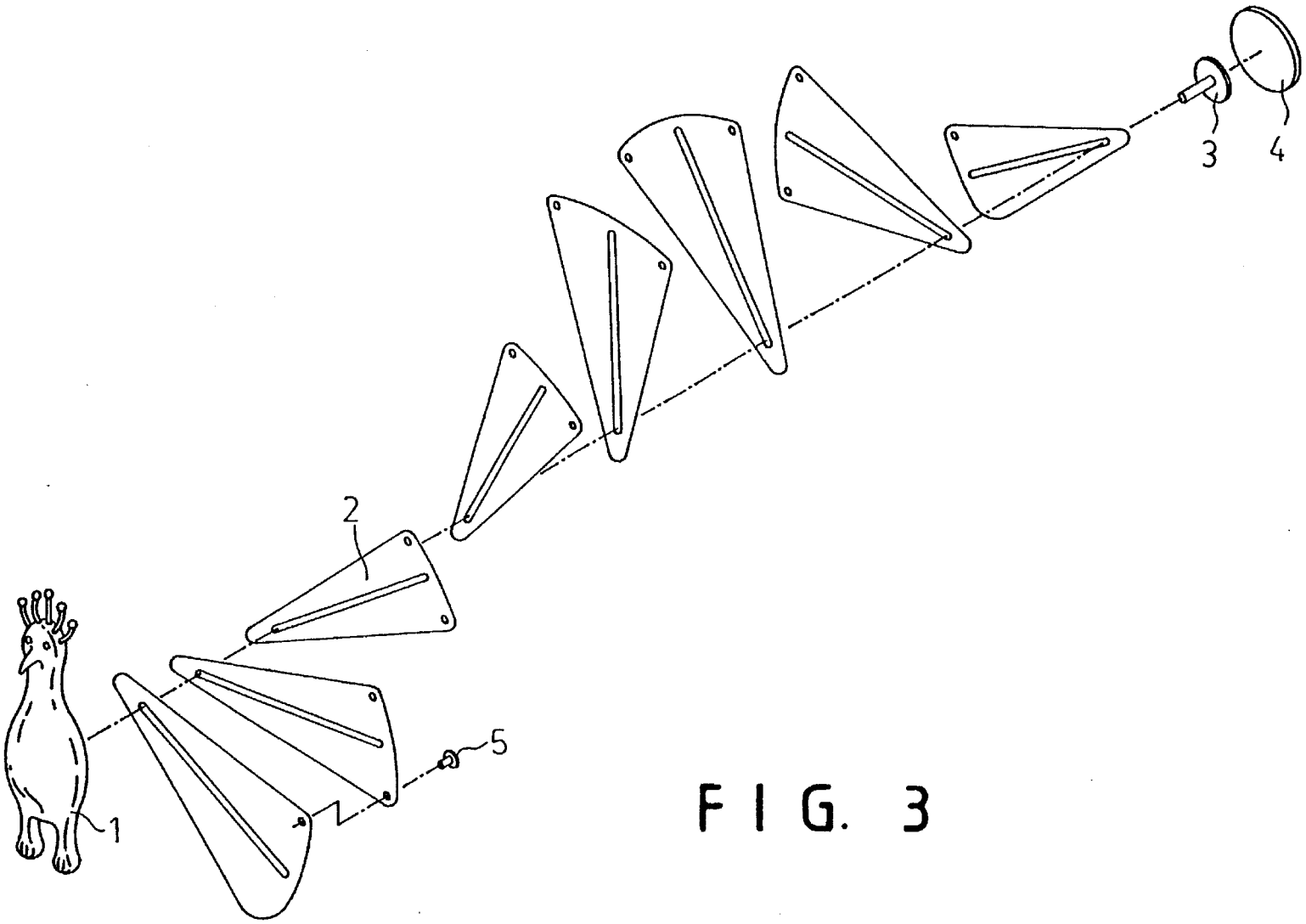
FIG. 3 is an exploded view of the present invention.
Figure 4:
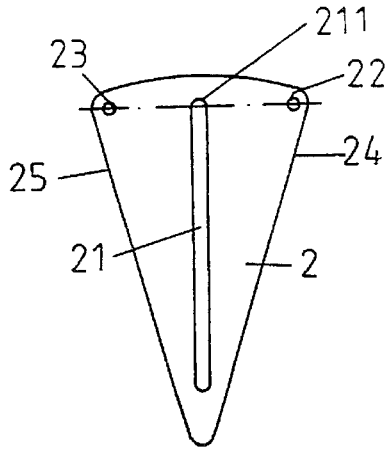
FIG. 4 is a top view of a sector.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIGS. 1, 2, 3 and 4 thereof, a foldable decoration according to the present invention mainly comprises a decorative body 1, a plurality of sector members 2, and a fixing pin 3. A cap 4 is engaged with said pin 3.

The decorative body 1 may be of any desired shape. The sector member 2 is a formed at the intermediate portion with an elongated slot 21 at the radial direction and two holes 22 and 23 at each of the outer corners. The upper end of the elongated slot 21 extends beyond the line joining the centers of the two holes 22 and 23 into an arc 211. The sector members 2 are joined together in a way such that the left edge 25 of a sector member 2 is laid upon the right edge 24 of an adjacent sector member 2 and pivotally connected thereto by a rivet 5 extending through the right hole 22 of the sector member and the left hole 23 of the adjacent sector member. However, it should be understood that the sector members 2 can also be joined so that the left edge 25 of the sector member is laid under the right edge 24 of an adjacent sector member 2.

Figure 5:
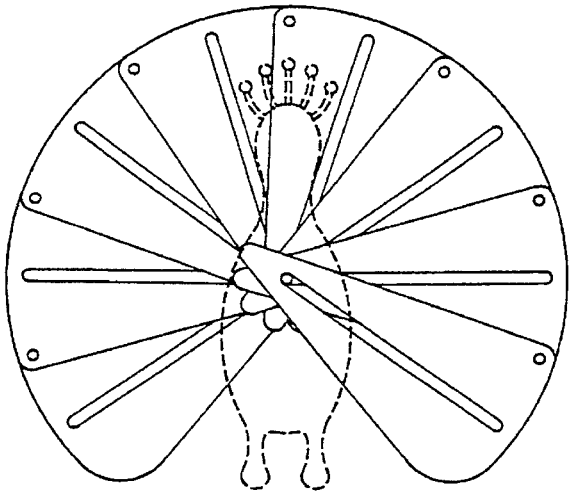
FIGS. 5, 6 and 7 show the working principle of the present invention.
Figure 6:
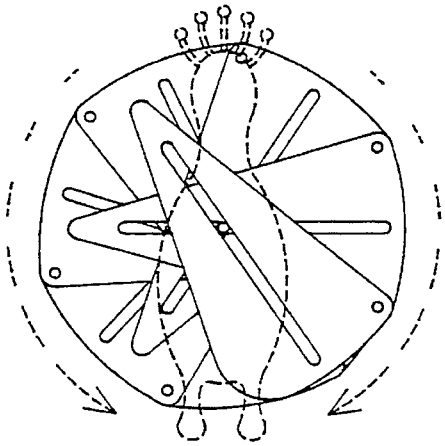
Figure 7:
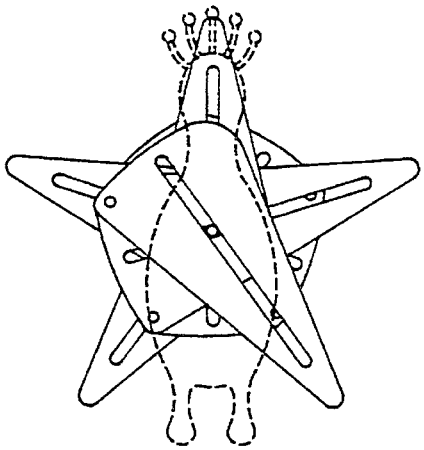
Figure 9:
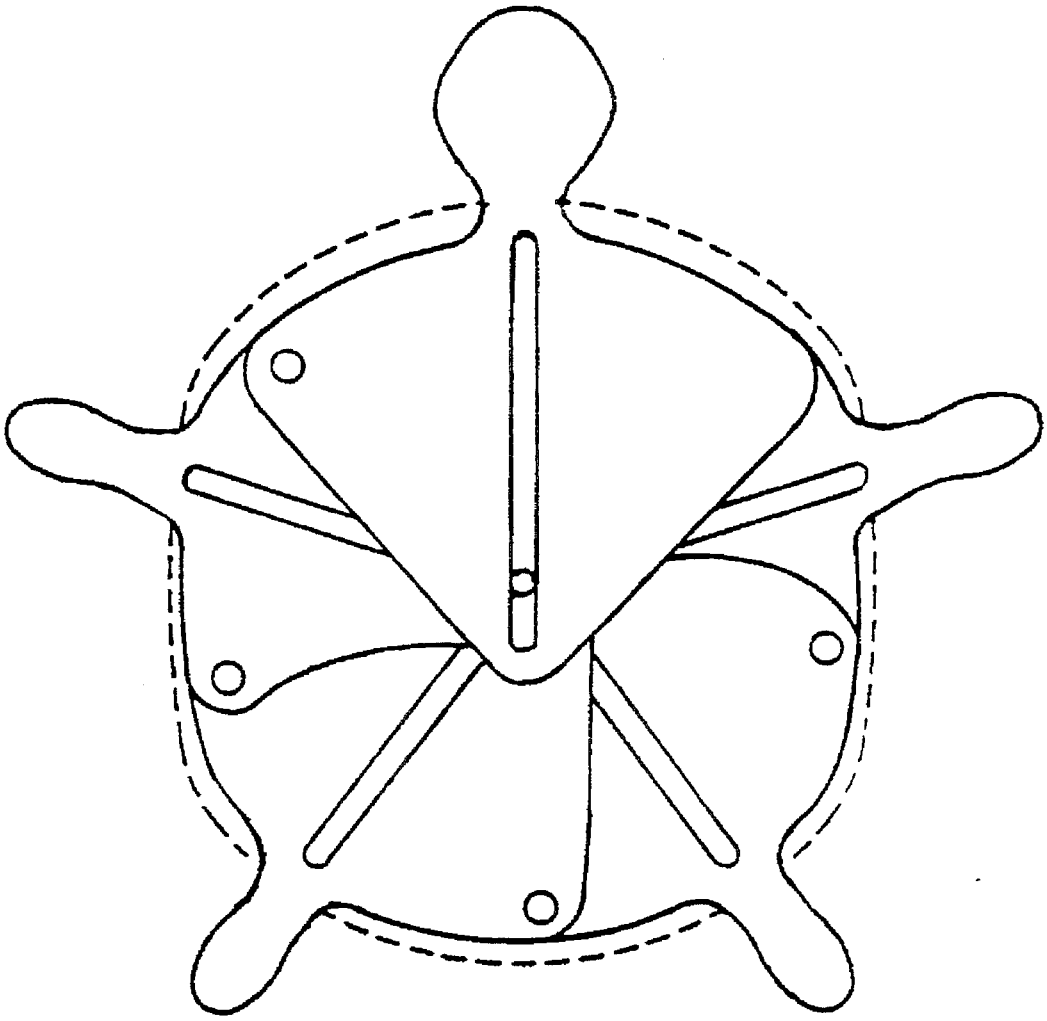
FIGS. 9, 10, 11 and 12 show other preferred embodiments of the present invention.
Figure 10:
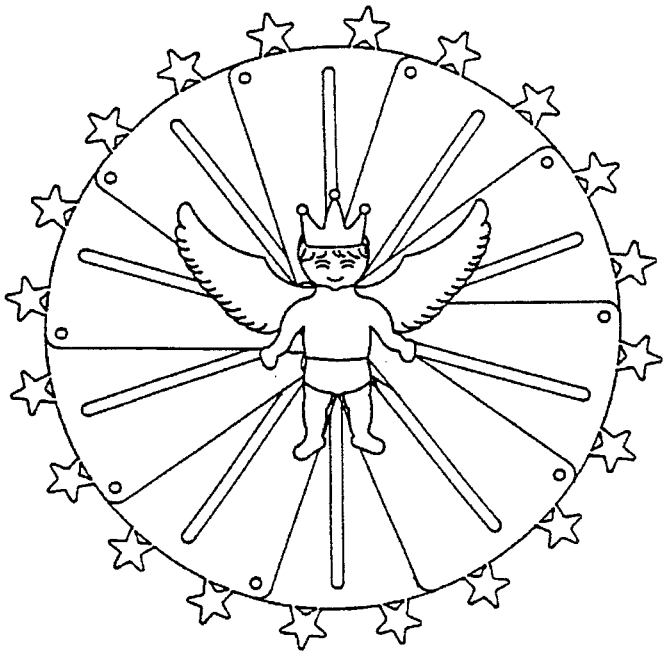
Figure 11:
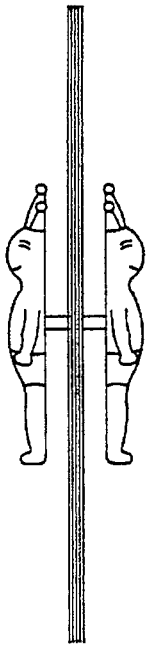
Figure 12:
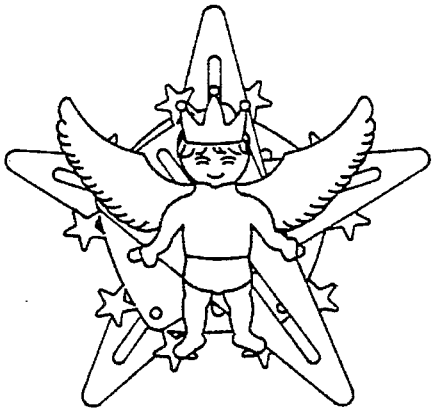

FIGS. 5, 6 and 7 show the working principle of the present invention.

Figure 8:
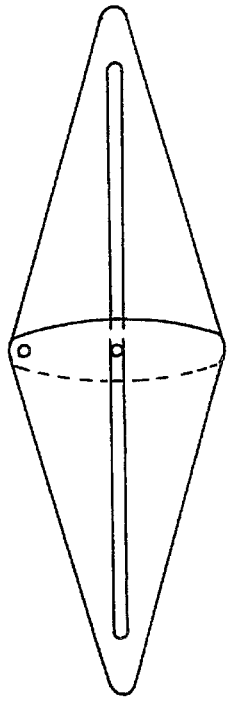
FIG. 8 shows the engagement between two sectors.

FIG. 8 shows the engagement between two sectors.

FIGS. 9, 10, 11 and 12 show other preferred embodiments of the present invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A foldable decoration comprising:

a decorative body;

a plurality of sector members having a first side, a second side and an arc between the first and second sides, each of said sector members being formed with a radial slot and two holes one at each end of the arc, said sector members being assembled so that the first side of one of said sector members is laid upon on the second side of an adjacent one of said sector members and pivotally connected thereto, the radial slot of said sector members extending beyond a line joining centers of the two holes at the upper ends of said arc;

a pin extending through the radial slot of said sector members; and a cap engaged with said pin.

* * * * *